United States Patent [19]

Patry

[11] 4,235,058

[45] Nov. 25, 1980

[54] ROOF STRUCTURE AND METHOD OF MAKING THE SAME

[75] Inventor: Francis J. Patry, Lewiston, Me.

[73] Assignee: Johns-Manville Corporation, Denver, Colo.

[21] Appl. No.: 952,890

[22] Filed: Oct. 19, 1978

Related U.S. Application Data

[63] Continuation-in-part of Ser. No. 816,413, Jul. 18, 1977, abandoned.

[51] Int. Cl.[2] ..... E04B 5/00

[52] U.S. Cl. ..... 52/408; 52/746

[58] Field of Search ..... 52/408, 309.8, 309.1, 52/409, 411, 746; 428/321

[56] References Cited

U.S. PATENT DOCUMENTS 3,411,256 11/1968 Best ..... 52/515 X

FOREIGN PATENT DOCUMENTS 2427056 12/1975 Fed. Rep. of Germany ..... 52/408

*Primary Examiner*—Price C. Faw, Jr.
*Assistant Examiner*—Carl D. Friedman
*Attorney, Agent, or Firm*—Robert M. Krone; Joseph J. Kelly; Gregory W. O'Connor

[57] ABSTRACT

An improvement in a roof structure including a built-up roof located over and above a roof deck and particulate material located over and above the built-up roof and method of preparing such a structure is disclosed herein. This improvement comprises the utilization of a relatively inexpensive, preferably flexible non-insulating sheet material which is located over and against the top surface of the built-up roof between the built-up roof and particulate ballast material. The primary purpose of this sheet material is to protect the built-up roof from the harmful effects of the sun and abrasion from the particulate ballast material. The primary purpose of the particulate material is to hold down the sheet material. In one embodiment, this non-insulating sheet material is substantially completely unattached to the built-up roof and in another embodiment it is attached to the built-up roof, at most, only at discrete spotted locations.

21 Claims, 3 Drawing Figures

ROOF STRUCTURE AND METHOD OF MAKING THE SAME

This application is a continuation in part of application Ser. No. 816,413, filed July 18, 1977, now abandoned.

BACKGROUND OF THE INVENTION

The present invention relates generally to roof structures and more particularly to the utilization of a relatively inexpensive "sacrificial" roofing membrane located over and above a roofing membrane, specifically a built-up roof, for at least temporarily protecting the latter from the elements.

In order to cover and protect a flat or substantially flat roof deck, conventional practice has heretofore dictated the utilization of insulation sheet material, for example perlite insulation board, a built-up roof and particulate material, specifically gravel, in that order. The build-up roof which extends over and above the deck and insulation material, protects both against weathering generally and the gravel protects the built-up roof against harmful rays of the sun, particularly the ultraviolet rays. This type of roof structure has for the most part been found to be satisfactory for its intended purpose. However, it does include one particular disadvantage. Specifically, while the built-up roof may in large part be protected against the ultraviolet rays of the sun by means of the gravel located over its top surface, it is not protected against the other elements in the ambient surroundings including for example the rain and snow. Moreover, unless care is taken to uniformly and completely cover the built-up roof with the gravel, the latter does not provide complete and uniform protection against the sun's harmful rays.

When there is a failure in a roof structure of the type described, particularly when this failure occurs after a number of years, it is caused by the built-up roof being directly exposed to the elements. One way to protect the built-up roof is described in U.S. Pat. No. 3,411,256 which issued to J. S. Best on Nov. 19, 1968. In this patent, a roof deck is covered with a water impermeable membrane, specifically a built-up roof, thermal insulating material and gravel, in that order. It will be noted that in this particular roof structure the location of the built-up roof relative to the roof insulation is just the opposite of that previously described above. As a result, the roof insulation, which is located over the built-up roof, reliably protects the latter against the elements and particularly against the ultraviolet rays of the sun and against thermal shock.

There is, however, one major drawback in the particular structure just described. Since the thermal insulation is itself exposed to the weather, it cannot be constructed of just any thermal insulating material. For example, it cannot be constructed of conventional perlite insulation board, but rather requires the utilization of a material which can withstand exposure to the elements over the life of the roof, which can be as long as or longer than twenty years. In the Best patent this insulation is described generally as comprising a plurality of closed cell water impermeable insulating members. Particular reference is made to cellular plastic foams of a closed cell configuration including styrene polymer foams, styrene-acrylonitrile copolymer foams, styrene-methylmethacrylate copolymer foams and other water impermeable materials available in cellular form.

While, as stated, the Best structure provides reliable protection to its built-up roof, there are three particular disadvantages in utilizing such a structure. First, the overall thermal efficiency of the foam insulation layer is reduced by precipitation or melting snow and ice running through the spaces between insulating members. Second, this type of structure can be used only where roof insulation is itself a necessary part of the overall structure. Where for example a roof structure does not require insulation, a system of the type described in the Best patent could not be used, unless of course one wanted to go to the expense of providing such insulation anyway. Third, this type of structure requires the utilization of a large amount of gravel, in the neighborhood of 1000 lbs/100 $ft^2$ to 1500 lbs/100 $ft^2$, in order to prevent flotation or blow-off of the closed cell insulation.

As will be seen hereinafter, the roof structure of the present invention eliminates these latter disadvantages of the Best structure while at the same time overcoming the previously discussed disadvantage of the more conventional roof structure described above.

SUMMARY OF THE INVENTION

One object of the present invention is to provide an otherwise conventional roof structure including a roofing membrane such as a built-up roof which is completely and reliably protected, at least temporarily, against the elements of its ambient surroundings and particularly against the harmful rays of the sun.

Another object of the present invention is to protect the built-up roof or other such membrane by utilizing a relatively inexpensive, non-insulating material which is applied directly between the built-up roof and gravel or other such ballast means and which is not required to last as long as the other components of the roof structure.

Still another object of the present invention is to provide protective sheet material which, if damaged, can be readily replaced without damaging the built-up roof or, if desired, can be completely ignored without causing damage to the remaining roof structure.

A further object of the present invention is to provide a roof structure which can be provided with less gravel or other such ballast means, by weight, than the Best patent roof structures described above and can be provided less desirable, hence less expensive, gravel without degrading appreciably the functioning of the overall roof structure.

As stated previously, the otherwise conventional roof structure to which the present invention is directed is one which includes a built-up roof or such other roofing membrane located over and above a roof deck and particulate ballast material or other such ballast means located over and above the built-up roof. Thermal insulating material may or may not be necessary and where necessary it would be located between the roof deck and built-up roof. In accordance with the present invention, this roof structure includes sheet material which is located over and against the top surface of the built-up roof between the built-up roof and particulate material. This sheet material is intended to serve one purpose and one purpose only, which is to completely and reliably protect the built-up roof or other such membrane against its ambient surroundings and particularly against the harmful rays of the sun. It is not intended to add any appreciable thermal insulation to the roof structure and it is not intended to act as any type of water barrier. As a result, it does not have to last as long as the remaining components of the roof structure and even if it becomes damaged and no longer provides protection for the built-up roof after a period of time, it can be ignored. Its sole purpose is to extend the overall life of the roof structure and particularly the built-up roof.

As a result of the foregoing, the protective sheet material in the roof structure of the present invention is selected so as to provide only the aforedescribed protection and not to add anything else to the overall structure. It is to be a material which is inexpensive and can be readily replaced or removed. In this regard, in one embodiment of the present invention, this sheet material is applied over the built-up roof so as to be substantially completely unattached therewith. In this way, should the material be damaged, it can be readily replaced if so desired without damaging the built-up roof. This could also be accomplished by partially attaching the sheet material to the built-up roof, that is, by attaching it only at discreet locations. In this way, the sheet material can be readily removed without damaging the built-up roof and yet, as it is being applied over the built-up roof, it will remain in place, at least until the gravel is applied over it. In addition to being readily removable and in order to keep its cost down, the sheet material is to be selected so as not to contribute any significant thermal insulation to the overall roof structure, that is, it should be an inexpensive, non-insulating sheet material. Obviously, all sheet material, even paper and foil contribute "some" thermal insulation. However, for the purposes of the present invention, the term "non-insulating sheet material" is intended to refer to that material which does not contribute in any significant way to thermal insulation of the roof or building arrangement generally, typically a material which is not considered a thermal insulating material for a building to those skilled in the art.

By providing a "sacrificial" protective membrane to what may otherwise may be a conventional roof structure, the life of the structure and particularly its built-up roof can be extended without adding unreasonably to its overall cost. Moreover, this is accomplished without having to utilize a particular type of thermal insulation as required in the Best patent discussed previously and without requiring a greater amount of gravel or other such particulate ballast material than is otherwise required in certain other conventional roof structures. When the sacrificial protective membrane is used in conjunction with a so called single membrane or loose-laid roofing system, less gravel or other such particulate material may be required since the sacrificial protective membrane would operate to protect the roof membrane from the harmful rays of the sun in lieu of a continuous, relatively thick layer of gravel. When used in conjunction with a conventional built-up roof, the instant invention eliminates the need for a continuous thick layer of fine gravel and the top pour of bituminous material in which this fine gravel is normally embedded.

A BRIEF DESCRIPTION OF THE DRAWINGS

DETAILED DESCRIPTION AND PREFERRED EMBODIMENTS

Figure 1:
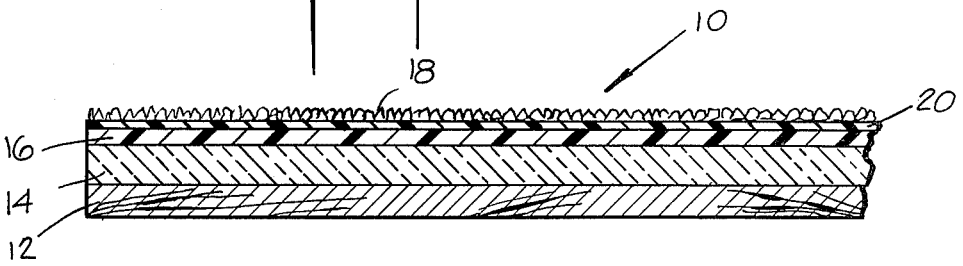
FIG. 1 is a vertical sectional view for a portion of a roof structure constructed in accordance with the present invention.

Turning to the drawings, wherein like components are designated by like reference numerals in the three Figures, a roof structure is disclosed and generally designated by the reference numeral 10. This roof structure includes a number of conventional components 16, which could more specifically be embodied as a roof deck 12, thermal insulation 14, a roofing membrane, specifically a built-up roof and a ballast means 18, specifically ballast material 18. However, as will be described in more detail hereinafter, roof structure 10 also includes what applicant refers to as a "sacrificial" membrane 20 for protecting the roofing membrane 16 from the ambient elements including sunlight, thermal shock and the like.

Inasmuch as roof structure 10 necessarily includes the built-up roof or other such roofing membrane, deck 12 will generally be horizontal or at most only slightly inclined with respect to the horizontal. However, the deck could of course be provided in any desired and suitable incline with the horizontal. In addition, this deck may be constructed of wood, cement, metal or other such suitable material, or it may be comprised solely of purlins or the like.

The roof structure constructed in accordance with the present invention may or may not include thermal insulating material 14. When such material is used, it may be of any suitable type such as Johns-Manville Corporation's FESCO insulation board. As illustrated in FIG. 1, this material 14, when used, is applied over and above deck 12, prior to application of built-up roof 16. A conventional moisture barrier 13, for example mopped asphalt or vapor barrier membrane, may be optionally provided between the roof deck and insulation.

Unlike thermal insulating material 14, roofing membrane 16 is a necessary component of roof structure 10, particularly since it is this particular component which is being protected by sacrificial protective membrane 20. As used herein, the term roofing membrane generally referes to a single or multiple ply construction including for example one or more layers of asphalt or other such bituminous impregnated or coated felt. However, a typical built-up roof is comprised of a plurality of asphalt impregnated or coated layers. Moreover, the roofing membrane or built-up roof as defined herein may comprise one or more plastic or elastomeric membranes in addition to or in lieu of the typical asphalt coated felts. These layers may or may not be bonded together and/or to the roof deck. Accordingly, it should be clear that roof structure 10 is not limited to any particular built-up roof construction. The built-up roof may be constructed of one or more plies of asphalt impregnated or coated organic felt such as rag felt. It may utilize asbestos or glass felts or any other suitable materials which provide the function of a built-up roof. In any event, however, in order to take advantage of the present invention, the roofing membrane or particularly the built-up roof would be of the type which would benefit from the utilization of a protective membrane such as membrane 20.

As stated previously, roof structure 10 also includes ballast 18 for holding sacrificial membrane 20 in place. While this material may be of any suitable type, for example spaced pavers, it is typically conventional gravel, for example river rock. The sole purpose for utilizing gravel or other such particulate ballast material is to hold down membrane 20, that is, to prevent it from moving either by means of flotation or by means of blow-off. This is to be contrasted with the primary purpose for utilizing gravel in what has previously been described as a conventional roof structure. In a conventional structure the gravel or other such particulate material is located directly over the built-up roof which is otherwise exposed to the ambient surroundings. The gravel in this case is provided as a protective screen against the sun's harmful rays. As a result, in conventional roof structures, it is necessary to completely and uniformly cover the built-up roof with the gravel. However, in the present invention, since the only purpose for particulate material 18 is to hold down membrane 20, the gravel or other such ballast means does not have to be applied uniformly. Further, the amount of ballast means used with the present invention should be compared to the amount of particulate material required for holding down the insulation material in the roof structure disclosed in the Best patent. As stated previously, this insulation in the Best patent is of a closed cell type and Applicant has found that at least 1000–1500 lbs/100 $ft^2$ of particulate material is required.

The instant invention, in addition to requiring less ballast material than certain other roofing systems, permits the use of certain types of aggregate which would be unacceptable in such other systems. In particular, because of the "cushioning" characteristics of sacrificial membrane 20 (as will be set forth more fully below), particulate ballast material 18 in its preferred form need not be river gravel. River gravel is normally specified as the ballast material for other roofing systems since the rounded, relatively smooth nature of such ballast material is less likely to cut and abrade the roof membrane of such other systems. In contrast to such systems, an aggregate of crushed or broken rock, or ordinary "bank run" gravel may be used in the instant invention. Preferably, such aggregate would have a range of minimum average diameter of about $\frac{3}{4}$ to $1\frac{1}{2}$ inches. The capability of using such broken gravel in lieu of the more rounded river gravel is advantageous in that river gravel is available, if at all, usually at a premium price as compared to such crushed or broken aggregate. This ability to use a wider range of available aggregates for particulate ballast material 18 is a considerable advantage over other systems.

Turning now to sacrificial membrane 20, it should first be noted that this membrane may be constructed of any sheet material so long as it meets certain requirements. First and foremost, the material must display sufficient strength so as to readily lay over built-up roof 16 without immediately tearing or otherwise being damaged during installation. Second, in order to keep its costs down the material must be a non-insulating sheet material, that is, one which does not provide any significant thermal insulation to the overall structure, as previously defined.

Thirdly, sacrificial membrane 20 should have a thickness adequate to not only resist the tearing as defined above but also to permit sacrificial membrane 20 to act as a cushion in order to absorb (in a sacrificial manner) the abrasions and impact from the initial or subsequent placement of particulate ballast material 18 as defined above. Membrane 20 should also endure the impact and abrasion associated with the movement of persons or equipment on the upper surface of the ballast material while it is in place on the upper surface of membrane 20. This third requirement is not merely an extension of the first requirement, (i.e., to not tear easily or otherwise be damaged during installation) although materials having this non-tearing characteristic have been found to be likely candidates to meet the cushioning requirement. On the contrary, the cushioning requirement is one aspect of the "sacrificial" nature of membrane 20 and connotes a gradual time wise degradation of membrane 20 during the performance of its function of withstanding or absorbing the various environmental stresses in lieu of built-up roof membrane 16.

Fourth and lastly, the non-insulating sheet materials selected as the sacrificial membrane 20 should be inherently weather resistant. This requirement permits membrane 20 to fulfill its "sacrificial" function for a reasonable period of time. The time period over which a single application of membrane 20 should function should be selected so as to optimize the tradeoff between the incremental cost of installing the membrane 20 and the benefits of extending useful life of the built-up roof membrane 16. It has been found that such a membrane 20 should have a life of approximately at least five years when subjected to normal North American Continent weather. During such a life span it can be seen that membrane 20 continuously degrades, either as a result of being subjected to the harmful rays of the sun and/or abrasion and other stresses because of its position between built-up roof 16 and particulate ballast 18. Accordingly, with an eye towards this eventual degradation and subsequent replacement, it is most beneficial to provide a relatively inexpensive material.

Figure 3:
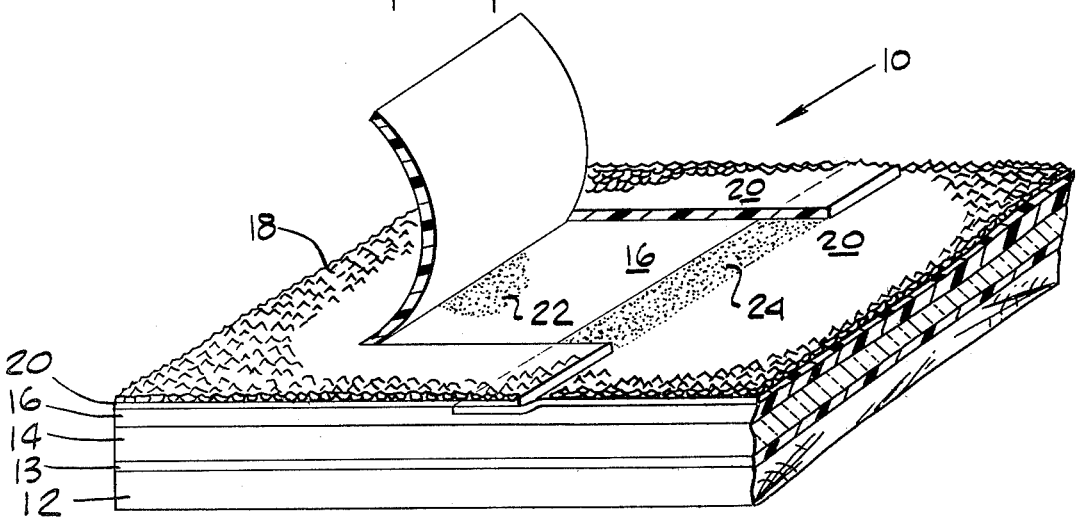
FIG. 3 is a perspective view of the roof structure similar to FIG. 2, but also showing a conventional moisture barrier, and showing a portion of the sacrificial membrane peeled back to show other optional features of the present invention.

By continuously replacing these sacrificial membranes at a relatively small cost as they become damaged, the expected life of the overall roof structure could be extended indefinitely. In this regard, it is important that membrane 20 either remain substantially completely unattached with the top surface, or be attached at most only at discrete spotted locations. The latter might be helpful to the roofer during application of gravel 18, especially if the membrane and/or gravel is being applied on a windy day. Conventional adhesive, for example hot asphalt (as shown as 22 of FIG. 3) may be spotted along the top surface of built-up roof 16 just prior to the application of membrane 20 to accomplish this.

Figure 2:
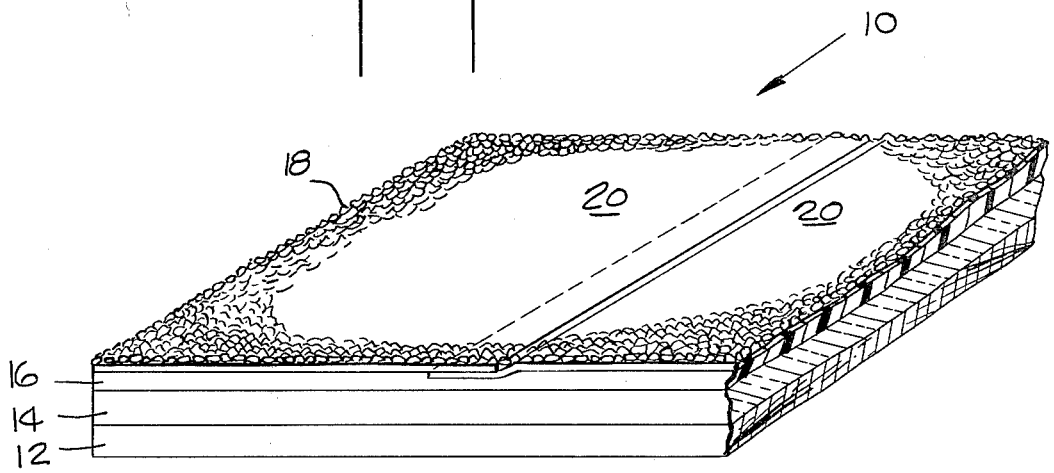
FIG. 2 is a perspective view of the roof structure illustrated in FIG. 1.

In accordance with a preferred embodiment of the present invention, membrane 20 is comprised of a plurality of flexible single ply sheets which are constructed of a polymeric material and which are arranged side-by-side to completely cover built-up roof 16, as illustrated in FIG. 2. Note that in this embodiment at least some of the edge portions of the sheets overlap one another. If desired these overlapped edged portions may be left unattached to one another, or they may be attached together by conventional adhesive (24 of FIG. 3) or by other suitable means.

One particular type of sheet material found to meet the various requirements recited above and one which is relatively inexpensive is constructed is a foamed cross-linked polyethylene having a thickness between 1/16 inch and $\frac{1}{4}$ inch and a density between 2 PCF and 2.5 PCF. In an actual working embodiment, this particular type of material is used and is approximately $\frac{1}{8}$ inch thick and has a density of approximately 2 PCF. In another working embodiment a material which was found to be advantageous for making up sacrificial membrane 20 is a foamed ionomer resin marketed by du Pont under the trademark SURLYN. A foamed neoprene rubber sheet could also be used. An unfoamed sheet material such as a heavily pigmented polyethylene sheet of at least 10 mils thickness could also be used, however such an unfoamed material has been found to be less desirable and less likely to meet the rigorous requirements as set forth supra. In all of the above examples, however, the sacrificial nature of the membrane 20 makes the overall roof system of the instant invention economically advantageous. Just as a "sacrificial" metal electrode in a cathodic protection system undergoes a continuous degradation in lieu of the major piece of capital equipment to which it is attached, the sacrificial membrane 20 of the instant invention, when properly installed and renewed at intervals, can prolong indefinitely the useful life of a major piece of capital equipment, namely the built-up roof membrane 16.

In the foregoing discussion, roof structure 10 was described as a new structure. It is to be understood that the present invention is equally applicable to "re-roofing". More specifically, when a new built-up roof or other such roofing membrane is applied over an existing roof, a sacrificial membrane 20 could be utilized in the manner described above to protect this new built-up roof. In this case, the entire existing "old" roof (with the exception of the gravel) could be viewed as the roof deck 12 for the new built-up roof 16 and membrane 20.

What is claimed is:

1. A roof structure comprising:

(a) a roof deck;

(b) a roofing membrane located over and above said deck;

(c) means for protecting said roofing membrane from at least the harmful rays of the sun, said means having particulate ballast material located thereon and comprising a non-insulating, polymeric, sheet material positioned over and against the top surface of said roofing membrane, said sheet material being resistant to tearing and having a thickness adequate to protect said roofing membrane from abrasion resulting from movement and impact of particulate ballast material located on and against the top surface of said non-insulating sheet material, said ballast material holding said non-insulating sheet material in place.

2. A roof structure according to claim 1 including thermal insulating sheet material located between said roofing membrane and said roof deck.

3. A roof structure according to claim 1 wherein said particulate ballast material, when located on and against the top surface of said non-insulating sheet material, is distributed at a rate of not more than 1000 lbs/100 $ft^2$.

4. A roof structure according to claim 1 wherein said non-insulating sheet material is flexible.

5. A roof structure according to claim 1 wherein said non-insulating sheet material includes a plurality of sheets, each of which includes a plurality of edge portions, at least some of said edge portions of said sheets overlapping one another, whereby said sheets together completely cover said roofing membrane.

6. A roof structure according to claim 5 wherein said overlapped edge portions are attached together.

7. A roof structure according to claim 1 wherein said non-insulating sheet material is constructed of a foamed cross-linked polyethylene having a thickness between about 1/16 inch and ¼ inch and a density between about 2 PCF and 2.5 PCF.

8. A roof structure according to claim 7 wherein said polyethylene sheet material is approximately ⅛ inch thick and has a density of approximately 2 PCF.

9. A roof structure according to claim 1 wherein said non-insulating sheet material is of such construction as to have a useful life of approximately at least five years when subjected to normal North American Continent weather while positioned over and against said top surface of said roof membrane.

10. A roof structure comprising:

(a) a roof deck;

(b) thermal insulating sheet material located over and above said deck;

(c) a built-up roof located over and above said thermal insulating sheet material;

(d) means for protecting said built-up roof from at least the harmful rays of the sun and from abrasion resulting from the movement of persons and equipment on said roof structure, said means comprising non-insulating flexible sheet material positioned over and against the top surface of said built-up roof and adhered to said top surface only at discrete spotted locations along said surface and said non-insulating sheet material including a plurality of sheets, each of which has a plurality of edge portions, at least some of said edge portions of said sheets overlapping one another, whereby said non-insulating sheets together completely cover said built-up roof arrangement; and (e) particulate material located on and held directly against the top surface of said non-insulating sheet material essentially solely by the weight of said particulate material, said weight amounting to not more than about 1000 lbs/100 $ft^2$.

11. A roof structure according to claim 10 wherein said non-insulating sheet material is constructed of a foamed, cross-linked polyethylene having a thickness between about 1/16 inch and ¼ inch and a density between about 2 PCF and 2.5 PCF.

12. A roof structure according to claim 11 wherein said polyethylene sheet material is about ⅛ inch thick and has a density of about 2 PCF.

13. A roof structure according to claim 10 wherein said non-insulating sheet material is constructed of a foamed ionomer resin.

14. A roof structure according to claim 10 wherein said overlapped edge portions are attached together.

15. In a roof structure including a built-up roof located over and above a roof deck and particulate material located over and above said built-up roof, the improvement comprising:

means for protecting at least the top surface of said built-up roof, said means comprising non-insulating sheet material made of a foamed ionomer resin and located over and against said top surface of said built-up roof between the latter and said particulate material, said non-insulating sheet material being attached to said top surface at most only at discrete spotted locations.

16. The improvement according to claim 15 wherein said non-insulating sheet material is substantially completely unattached with said top surface.

17. In a method of preparing a roof structure including installing a built-up roof over and above a roof deck and thereafter applying particulate ballast material over and above said built-up roof, the improvement comprising:

protecting at least the top surface of said built-up roof from harmful rays of the sun and abrasion from said particulate ballast material by applying non-insulating sheet material over and above the top surface of said built-up roof between said top surface and said particulate ballast material, said non-insulating sheet material being attached to said top surface at most only at discrete locations.

18. The improvement according to claim 17 wherein said non-insulating sheet material is substantially completely unattached with said top surface.

19. A roof structure comprising:

(a) a roof deck;

(b) a roofing membrane located over and above said deck;

(c) particulate ballast material located as the uppermost layer of said roof structure;

(d) a sacrificial membrane positioned over but substantially completely unattached to the top surface of said roofing membrane, said sacrificial membrane having a resistance to tearing adequate to permit the installation of said sacrificial membrane on and against the top surface of said roofing membrane; be essentially non-insulating; have a thickness adequate to protect said roofing membrane from impact and abrasion resulting from the placement and movement of said ballast material, said sacrificial membrane being constructed of sheet material having inherently weather resistant properties such that when exposed to normal North American Continent weather while in position on said roofing membrane, said sheet material will have a useful life of approximately at least five years.

20. A roof structure according to claims 1, 10, or 19 wherein said roofing membrane is a conventional built-up roof membrane.

21. A roof structure according to claims 1, 10 or 19 wherein said roofing membrane is a single-ply roofing membrane.

* * * * *